United States Patent [19]

Fenner

[11] Patent Number: 4,696,470

[45] Date of Patent: Sep. 29, 1987

[54] PORTABLE PLATFORM ASSEMBLY FOR DANCERS AND THE LIKE

[76] Inventor: Edwin H. Fenner, 2909 Princeton, Midland, Tex. 79701

[21] Appl. No.: 818,598

[22] Filed: Jan. 13, 1986

[51] Int. Cl.[4] ..... A63B 5/02; F16C 11/00; E04G 1/34

[52] U.S. Cl. ..... 272/144; 272/102; 403/61; 403/95; 182/153

[58] Field of Search ..... 272/62, 63, 3, 103, 272/102, 144, 109; 248/439; 182/152, 153; 403/61, 85, 95

[56] References Cited

U.S. PATENT DOCUMENTS

| | | | |
|---|---|---|---|
| 1,546,192 | 7/1925 | Berg | 403/95 |
| 2,838,353 | 6/1958 | Emmert | 403/61 |
| 3,079,914 | 3/1963 | Bush | 128/25 R |
| 4,183,695 | 1/1980 | Wilcox | 272/102 |

FOREIGN PATENT DOCUMENTS

| | | | |
|---|---|---|---|
| 243633 | 12/1925 | United Kingdom | 272/103 |

*Primary Examiner*—Richard J. Apley
*Assistant Examiner*—S. R. Crow
*Attorney, Agent, or Firm*—Vinson & Elkins

[57] ABSTRACT

A portable platform assembly includes a platform (12) and a folding barre structure (14) mounted for pivotal movement about spaced supporting bases (16, 18) on the platform (12 ) between an upright position and a collapsed inoperable position relative to the platform (12). The folding barre structure (14) has a pair of parallel spaced legs (24, 26) adjustable in height and a horizontal barre or rail (34) secured to the upper ends of the legs (24, 26) for supporting the arms or legs of a person thereon.

6 Claims, 6 Drawing Figures

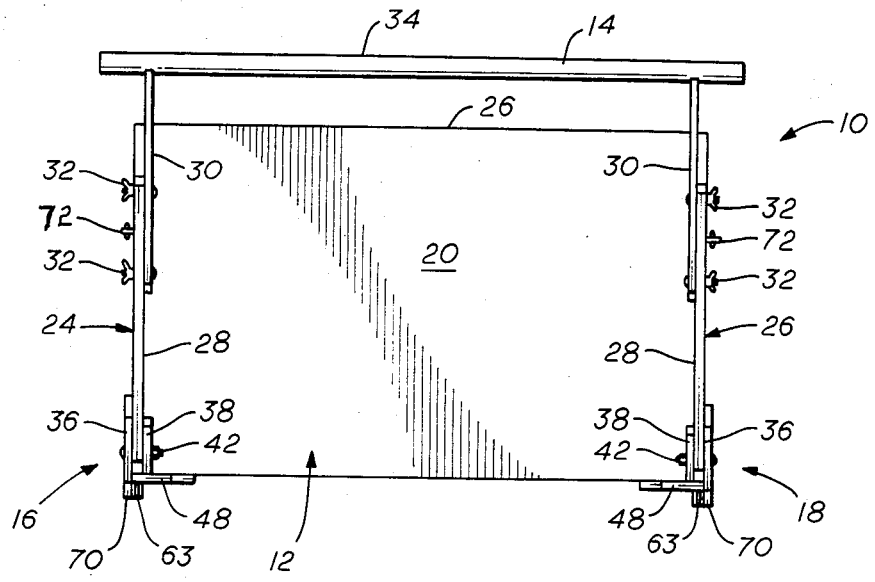
FIG. 4
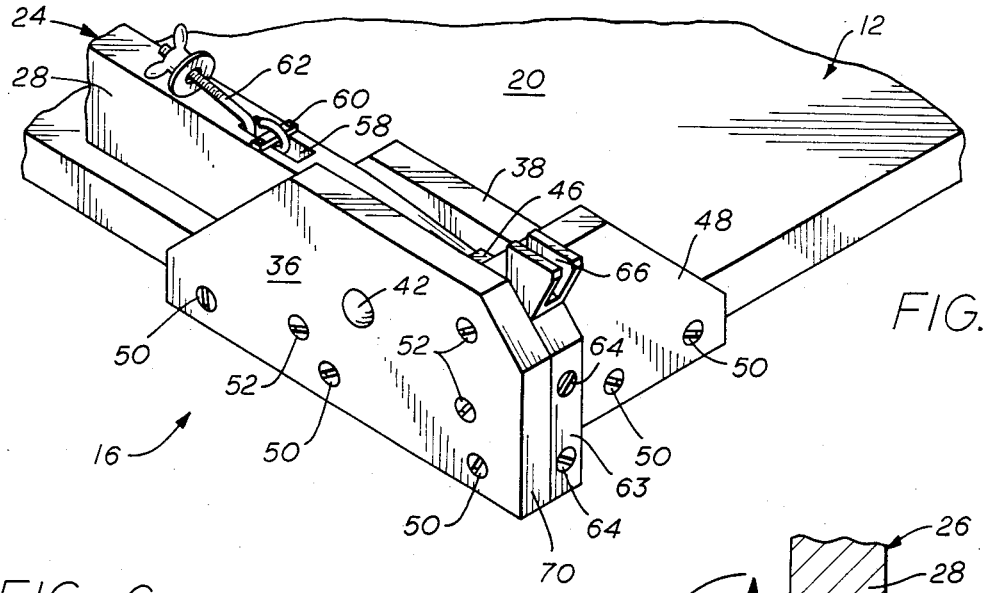
FIG. 5
FIG. 6
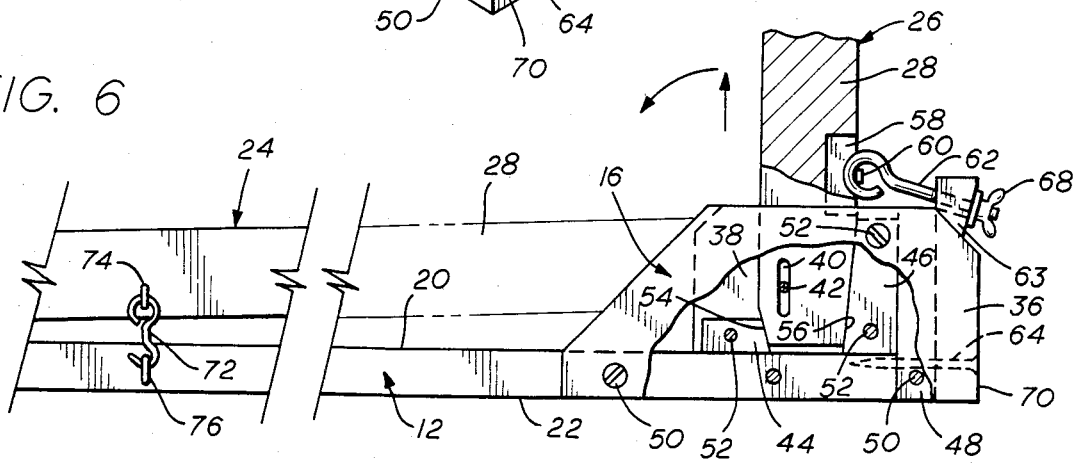

PORTABLE PLATFORM ASSEMBLY FOR DANCERS AND THE LIKE

BACKGROUND OF THE INVENTION

This invention relates to a portable platform assembly for dancers or exercisers, and more particularly to such a platform assembly having a platform to support a dancer thereon and a foldable barre structure mounted on the platform for pivotal movement between an upright operable position for use by a dancer and a collapsed inoperable position for transport or storage.

Heretofore, such as shown in U.S. Pat. No. 2,932,510 dated Apr. 12, 1960, a portable knock-down ballet barre which is a practice bar for a ballet studio or the like has been provided which is adjustable in height for ballet dancers. Such a ballet barre has been knocked down or disassembled for movement from place to place or for storage.

Also, as shown in U.S. Pat. No. 2,812,944 dated Nov. 12, 1957, a dance barre has been attached to a wall in a dance studio and has been folded flat against the wall when not in use, while extended out from the wall for use as well as being adjustable in height. Such prior dance barres have not been combined with a platform supporting a dancer thereon for practice or exercise.

U.S. Pat. No. 2,048,587 dated July 21, 1936 discloses an exercising apparatus having a platform supported by a supporting block to provide an inclined surface for a person to rest in a reclining position while using his or her feet to engage a revolving ball on a shaft. The uprights supporting the shaft are pivotally mounted on the block under the platform.

SUMMARY OF THE INVENTION

This invention is directed particularly to a portable dance platform assembly having a platform for supporting a dancer thereon and a barre structure foldable between a collapsed inoperable position on the platform for transport or storage, and an extended operable position perpendicular to the platform for supporting legs or arms of a dancer thereon for practice or exercise. The dance platform of the assembly is of a generally rectangular shape and has an upper supporting surface extending in a horizontal direction to support a dancer thereon, and a mounting bracket or base is secured to each of a pair of adjacent corners of the platform to support a foldable barre structure for pivotal movement between an operable upright position and a collapsed inoperable position against the platform. When in collapsed folded position the assembly may be easily transported and/or stored in a relatively small space.

The foldable barre structure includes a pair of generally parallel legs or frame members pivotally mounted at their lower ends to the pair of mounting bases and a barre or rail extends between the upper ends of the frame members in a horizontal direction when in extended operable position. The barre or rail extending between the frame members is adjustable in height and adapted to be contacted by the body of a dancer supported on the platform for at least partial support of the arms or legs of the dancer during ballet practice or the like.

Since the foldable barre structure is pivotally connected to a pair of mounting bases on the corner of the platform, the collapsed platform assembly has minimal dimensions especially upon adjustment of the uprights or frame members to a fully retracted position. Such minimal dimensions aid in the transport or storage of the collapsed assembly, since only a minimal space is required.

Such a platform assembly permits a ballet dancer or the like to practice or exercise in a variety of locations other than a dance studio. For example, the dance platform assembly of the present invention might be positioned in various rooms of a home, on a patio, on the ground, or wherever a horizontal supporting surface is provided. The platform is preferably formed of a clear hardwood with a hard supporting surface such as normally encountered by a dancer and its lower surface is in contact with and supported on the horizontal supporting surface. Since a dancer may exert substantial force against the dance barre, the mounting brackets or bases for the legs or frame members must be sturdy, and each mounting base includes a pair of parallel support members secured to the platform between which the frame members fit and are mounted for pivotal movement. When pivoted to an upright operable position, the uprights of the foldable barre structure engage an abutting surface of the support base and suitable retainer means releasably retains the barre structure in extended vertical position.

It is an object of the present invention to provide a portable dance platform assembly having a platform for supporting a dancer and a foldable barre structure mounted thereon for pivotal movement between a collapsed inoperable position for transport or storage, and an extended operable position to support a dancer thereon for practice or exercise.

It is a further object of the invention to provide such a collapsible portable dance platform assembly in which the platform is of a generally rectangular shape, and the foldable barre structure includes a pair of parallel frame members pivotally supported on the platform and a vertically adjustable dance barre between the upper ends of the frame members.

It is a further object of this invention to provide such a collapsible portable dance platform assembly in which a dance platform has a pair of sturdy mounting brackets or bases thereon and the foldable barre structure is pivotally mounted to the bases.

Other objects, features, and advantages of this invention will become more apparent after referring to the following specification and drawings.

FIG. 4 is a side elevational view of the portable platform assembly of FIGS. 1–3 illustrating the assembly in a folded or collapsed position for transport or storage;

Figure 2:
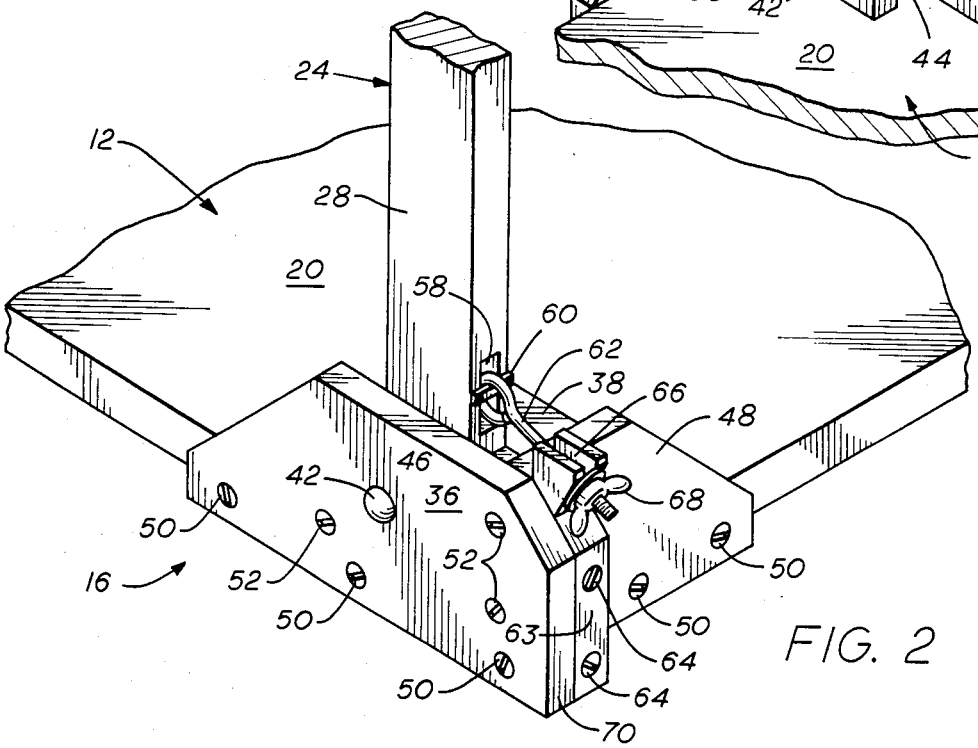
FIG. 2 is an enlarged perspective view of the mounting base positioned on the corner of the platform for pivotally mounting the folding barre structure.

FIG. 5 is an enlarged perspective view of the mounting base shown in FIG. 2 but showing the upright frame member of the folding barre structure in a collapsed position on the upper surface of the platform; and FIG. 6 is a side elevational view of the mounting base shown in FIG. 5 with certain parts broken away and illustrating the pivotal movement of the barre structure from its operable extended position to its collapsed inoperable position.

Figure 1:
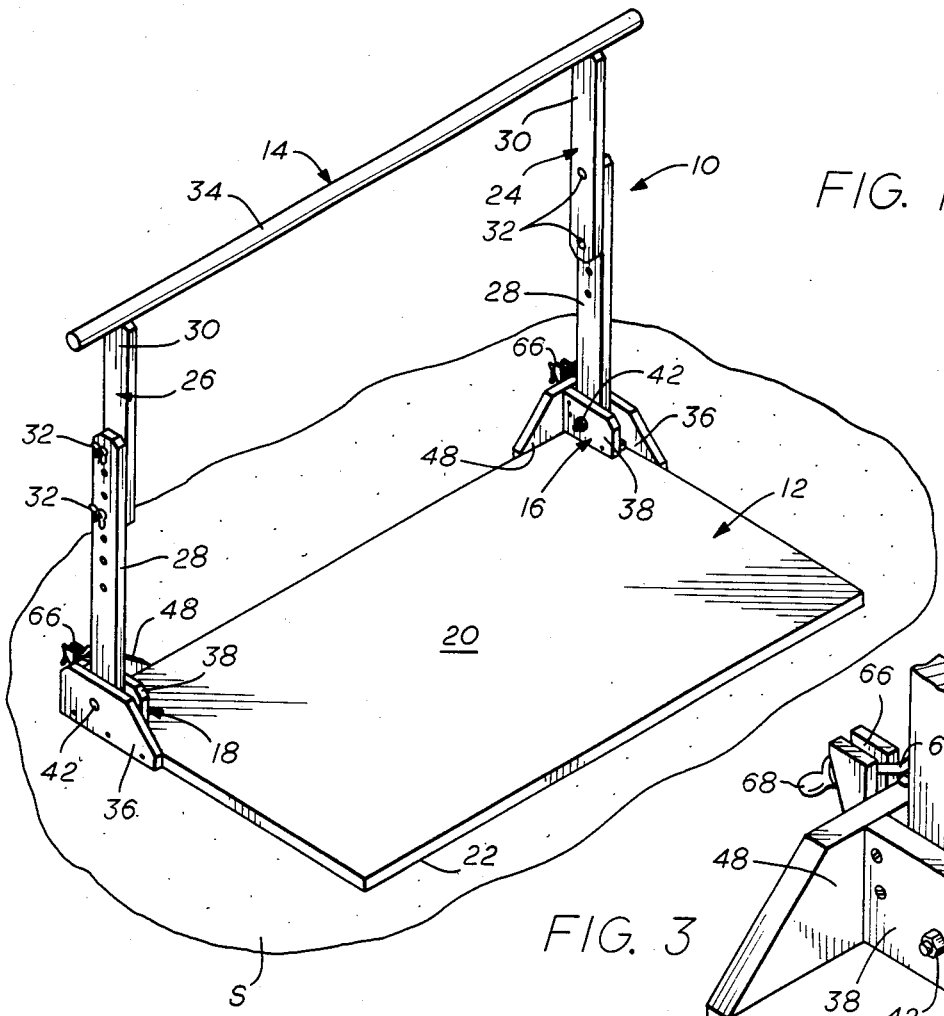
FIG. 1 is a perspective view of the portable dance platform assembly of the present invention illustrating the dance platform in an operable extended position for supporting a dancer thereon.
Figure 3:
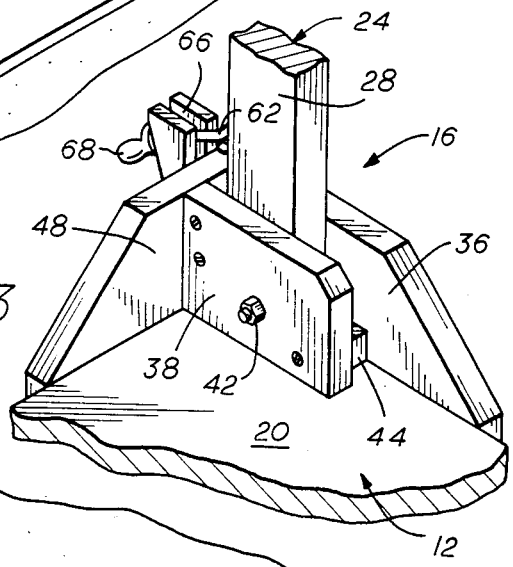
FIG. 3 is a perspective view of the mounting base shown in FIG. 2 taken from an opposite side thereof.

Referring now to the drawings for a better understanding of this invention, the portable platform assembly comprising the present invention is illustrated generally at 10 and includes a platform generally indicated at 12, a folding barre structure indicated generally at 14, and mounting brackets or bases 16 and 18 secured to platform 12. Mounting bases 16 and 18 support foldable barre assembly 14 for pivotal movement between the extended operable position as shown in FIG. 1 and an inoperable collapsed position as shown in FIG. 4. Platform 12 has an upper support surface 20 and a lower or bottom support surface 22. Bottom surface 22 is supported on a flat horizontal surface S which may be the floor of a room, the ground, a patio, or a similar horizontal supporting surface. Upper surface 20 may be coated with wax or suitable plastic material to provide a wear resistant surface thereon. Platform 12 is preferably formed of a clear hardwood material, such as maple, oak, or ash, for example. Platform 12 is of a rectangular shape and may have a length of around five feet with a width of around three feet, for example.

Folding barre structure 14 includes a pair of parallel spaced legs or frame members generally indicated at 24 and 26, each having a lower portion 28 and an upper portion 30 adjustably secured to each other by suitable bolt and wingnut combination 32 through aligned openings thereby to provide vertical adjustment of members 28 and 30 relative to each other. A horizontal barre or rail 34 extends between and is secured to the upper ends of upper portions 30. Barre 34 extends in a horizontal direction in its extended operable position for supporting the arms or legs of a dancer thereon during a dancing practice or exercise.

Barre structure 14 is mounted for pivotal movement about the lower ends of lower portions 28 between a collapsed inoperable position as shown in FIG. 4 and an extended operable position as shown in FIG. 1. Mounting bases 16 and 18 are mounted on a pair of adjacent corners of platform 12 and extend upwardly therefrom. Each mounting base 16 and 18 is generally identical and only base 16 is described in detail, it being understood that base 18 is similar. Base 16 comprises a pair of parallel, spaced support members 36 and 38 defining outer and inner sides for base 16 and extending in a generally perpendicular direction with respect to the upper horizontal surface 20 of platform 12. The lower end of associated end portion 28 is received between support members 36, 38 and has an elongate slot 40 therein which receives a suitable nut and bolt combination indicated generally at 42 extending through aligned openings in members 36 and 38 for mounting barre structure 14 for pivotal movement between its extended operable position shown in FIG. 1 and its collapsed inoperable position shown in FIG. 4.

As shown particularly in FIG. 6, a front spacer block 44 and a rear spacer block 46 fit between parallel support members 36 and 38. Lower end portion 28 is positioned between front spacer block 44 and rear spacer block 46. An abutting support member 48 defining a back for base 16 extends behind rear spacer block 46 and inner support members 38 in a perpendicular direction. Suitable fasteners 50, such as metal screws adapted for use on wood, secure support members 36 and 48 to adjacent edges of platform 12. Fasteners 52 extend between parallel members 36 and 38 through spacer blocks 44 and 46 to secure spacer blocks 44 and 46 in position.

As noted in FIG. 6, end portion 28 has a lower front side tapered at 54 and a lower rear side tapered at 56. Blocks 44 and 46 are provided with tapers matching and engaging tapered sides 54, 56 which may be, for example, around eight degrees (8°) with respect to the longitudinal axis of end portion 28. Such an arrangement provides a wedging action with a resulting sturdy tight fit between end portion 28 and spacer blocks 44 and 46, and permits the associated barre assembly 14 to be lifted upwardly slightly and then folded downwardly onto upper surface 20 of platform 12 when desired for storage or transport.

End portion 28 has a slot 58 therein with a metal retaining bar 60 extending across the open side of slot 58. An eye bolt 62 has its eye fitted around bar 60. A retainer block shown at 63 is secured by fasteners 64 to the outer face of support member 48 and has an upper slot 66 therein to receive eye bolt 62 as shown in FIGS. 2 and 6. A suitable wingnut 68 and associated washer on eye bolt 62 releasably retains lower end portion 28 in position as shown. It is noted that in the extended operable position of platform assembly 10 as shown in FIG. 1, lower surface 22 of platform 12 and adjacent lower surfaces of support members 36 are in supporting contact with supporting surface S. However, in the collapsed position as shown in FIG. 4 with platform 12 extending generally in a vertical direction, end surfaces 70 of support members 36 and the adjacent surfaces of retainer members 63 are in supporting contact with surface S to support the entire weight of the portable platform assembly 10 thereon.

For folding platform assembly 10 to the position of FIG. 4, wingnuts 68 are loosened and swung upwardly. Then folding barre structure 14 is lifted upwardly slightly to remove lower end portions 28 from between spacer blocks 44 and 46, thereby to permit folding or collapsing to the position shown in FIGS. 4 and 6. To releasably retain assembly 10 in collapsed position, a retaining hook 72 is carried by an eye 74 on lower end portion 28 and engages an eye 76 on platform 12 in a collapsed position as shown in FIG. 4 thereby to secure platform assembly 12 in collapsed position as shown for transport or storage.

From the above, it will be understood that portable dance platform assembly 10 has a generally rectangular platform 12 which supports a foldable barre structure 14 thereon for pivotal movement between a collapsed inoperable position for transport or storage, and an extended operable position to support a person thereon for practice or exercise. Sturdy mounting brackets or support bases 16, 18 are secured to a pair of adjacent corners of platform 12 to mount folding bare structure 14 on the platform for pivotal movement.

When used herein, the term "dance" platform or "dance" platform assembly shall be interpreted to include such a platform or platform assembly utilized by persons other than dancers, such as, for example, by persons exercising or the like.

While preferred embodiments of the present invention have been illustrated in detail, it is apparent that modifications and adaptations of the preferred embodiments will occur to those skilled in the art. However, it is to be expressly understood that such modifications and adaptations are within the spirit and scope of the present invention as set forth in the following claims.

What is claimed is:

1. A portable platform assembly foldable between a collapsed inoperable position for storage and an extended operable position for supporting a person thereon comprising:

a platform of a generally rectangular shape in a plan view and having four corners, said platform in the extended operable position of said assembly defining an upper horizontal surface for supporting a person thereon;

a support base on each of a pair of adjacent corners of said platform extending upwardly from said platform in the extended operable position thereof to provide a pivotal mount, said support base having a pair of spaced generally parallel inner and outer side support members secured to and extending upwardly from said platform in said operable position;

a pair of generally parallel legs pivotally mounted at their lower ends to the pair of support bases and adapted to be pivoted between an extending position at right angles to said platform in said operable position and a generally parallel position with said platform in said collapsed position for storage of said assembly, said legs having lower end portions fitting between and pivotally mounted to said spaced support members of said bases for pivotal movement between extended and collapsed positions;

front and rear spacer blocks positioned between each pair of support members adjacent opposite sides of the associated legs and receiving said legs tightly therebetween in the operable position of said platform to support said legs thereat; and a rail extending between the upper ends of said parallel legs adapted to be contacted by the body of a person supported on the platform in the operable position of said assembly.

2. A portable platform assembly foldable between a collapsed inoperable position for storage and an extended operable position for supporting a person thereon comprising:

a platform of a generally rectangular shape in plan view and having four corners, said platform in the extended operable position of said assembly defining an upper horizontal surface for supporting a person thereon;

a support base on each of a pair of adjacent corners of said platform extending upwardly from said platform in the extended operable position thereof to provide a pivotal mount, said support base having a pair of spaced generally parallel inner and outer side support members secured to and extending upwardly from said platform in said operable position;

a pair of generally parallel legs pivotally mounted at their lower ends to the pair of support bases and adapted to be pivoted between an extending position at right angles to said platform in said operable position and a generally parallel position with said platform in said collapsed position for storage of said assembly, said legs having lower end portions fitting between and pivotally mounted to said spaced support members of said bases for pivotal movement between extended and collapsed positions;

each of said support bases including a rear support member secured to said platform and extending perpendicularly to said inner and outer side support members behind the associated leg, a retainer block secured to said rear support member, and releasable securing means between the retainer block and associated leg to releasably retain the leg in extended upright position; and a rail extending between the upper ends of said parallel legs adapted to be contacted by the body of a person supported on the platform in the operable position of said assembly.

3. A portable dance platform assembly foldable between a collapsed inoperable position for storage and an extended operable position for supporting a dancer thereon comprising:

a platform of a generally rectangular shape in plan view and having four corners, said platform in the extended operable position of said assembly defining a horizontal supporting surface for supporting a dancer thereon;

a support base on each of a pair of adjacent corners of said platform extending upwardly from said platform in the extended operable position thereof to provide a pivotal mount, said support base including a pair of spaced inner and outer parallel sides;

a pair of generally parallel legs fitting between said inner and outer sides of said support bases mounted at their lower ends for pivotal movement on said support base between said extended operable position at right angles to said platform and a generally parallel position with said platform in said collapsed position for storage of said assembly, each support base including front and rear spacer blocks positioned between said inner and outer sides on opposite sides of an associated leg therebetween;

a dance barre extending between the upper ends of said legs adapted to be contacted by the body of a dancer supported on the platform in the operable position of said assembly;

means mounting said dance barre for vertical adjustment in height relative to said platform thereby to accommodate dancers of varying heights; and means adjacent the pivotal mount for each mounted leg mounting said leg for limited vertical movement relative to its associated support base, said leg fitting tightly between said spacer blocks upon downward movement of said leg when said leg is initially placed in an extended position, said leg being raised slightly with respect to said spacer blocks for release from such tight fitting relation and subsequent pivoting to a collapsed position.

4. A portable dance platform as set forth in claim 3 wherein said leg has its lower end tapered on opposite sides thereof adjacent said spacer blocks with the tapered sides engaging said spacer blocks in extended position thereof; and the adjacent surfaces of said spacer blocks contacting such legs have matching tapers thereby to provide a wedging of said leg upon a downward movement thereof when in extended operable position.

5. A portable platform assembly foldable between a collapsed inoperable position for storage and an extended operable position for supporting a person thereon comprising:

a platform of a generally rectangular shape in plan view and having four corners, said platform in the extended operable position of said assembly defining an upper horizontal surface for supporting a person thereon;

a support base on each of a pair of adjacent corners of said platform including a pair of spaced inner and outer sides extending upwardly from said platform in the extended operable position thereof to provide a pivotal mount;

a pair of generally parallel legs pivotally mounted at their lower ends between the inner and outer sides of the associated support bases and adapted to be pivoted between an extending position at right angles to said platform in said operable position and a generally parallel position with said platform in said collapsed position for storage of said assembly, each support base including a rear abutting support member secured to said platform behind the associated leg and inner side for supporting said leg in its extended position;

releasable retaining means between the associated leg and said rear support member to releasably retain the leg in an extended upright position; and a rail extending between the upper ends of said parallel legs adapted to be contacted by the body of a person supported on the platform in the operable position of said assembly.

6. A portable platform assembly as set forth in claim 5 wherein said releasable retaining means comprising an eye bolt pivotally connected to said leg and fitting within a slot on said rear support member for being releasably secured therein.

* * * * *